United States Patent [19]

Florjancic

[11] Patent Number: 4,800,871

[45] Date of Patent: Jan. 31, 1989

[54] MUSCLE RELAXING DEVICE

[75] Inventor: Peter Florjancic, Wallgau, Fed. Rep. of Germany

[73] Assignee: PVG Patentverwertungsgesellschaft mbH, Grainau, Fed. Rep. of Germany

[21] Appl. No.: 903,302

[22] Filed: Sep. 3, 1986

[30] Foreign Application Priority Data

Sep. 3, 1985 [DE] Fed. Rep. of Germany ..... 3531342

[51] Int. Cl.[4] ..... A61H 1/02

[52] U.S. Cl. ..... 128/75; 441/123

[58] Field of Search ..... 128/75, 68, 25 R, DIG. 20, 128/DIG. 23; 441/123

[56] References Cited

U.S. PATENT DOCUMENTS

| | | | |
|---|---|---|---|
| 2,210,809 | 8/1940 | Gray | 441/123 |
| 2,742,654 | 4/1956 | Hurt | 441/123 X |
| 2,806,471 | 9/1957 | Breese | 128/DIG. 23 X |
| 3,024,784 | 3/1962 | Monfardini | 128/75 |
| 3,048,860 | 8/1962 | Richardson | 441/123 |
| 3,512,523 | 5/1970 | Barnett | 128/75 |
| 3,750,205 | 8/1973 | Pfeifer | 441/123 |
| 4,099,523 | 7/1978 | Lowrey | 128/75 |
| 4,204,529 | 5/1980 | Cochrane | 128/75 |
| 4,232,663 | 11/1980 | Newton | 128/75 |
| 4,236,264 | 12/1980 | Britzman | 441/123 X |
| 4,297,758 | 11/1981 | Moran | 441/123 |

FOREIGN PATENT DOCUMENTS

| | | | |
|---|---|---|---|
| 2322823 | 11/1974 | Fed. Rep. of Germany | 441/123 |

OTHER PUBLICATIONS

"Solutions Products That Make Life Easier" (advertisement photocopy) p. 19.

*Primary Examiner*—Thomas F. Callaghan
*Attorney, Agent, or Firm*—Penrose Lucas Albright; Robert A. Miller

[57] ABSTRACT

Device for water therapy and exercise that allows the human body to float in an essentially vertical position suspended along a line of the chin, jaw and lower rear cranium just above the nape of the neck without constricting wearer's throat. The device is an annular inflatable tube divided into upper and lower hermetically sealed separate chambers of different sizes, having a cross-section which increases gradually from the chin portion to the nape portion, and as seen in plan has generally the shape of the Greek capital letter omega.

12 Claims, 2 Drawing Sheets

MUSCLE RELAXING DEVICE

SUMMARY OF THE INVENTION

This invention relates to muscle relaxing device for passive stretching of the wearer's spinal column in water with relaxed musculature. A device of this type allows relaxation of all of the human body's voluntary muscles by supporting the body while floating in water with the body immersed up to the wearer's neck so that no voluntary muscle need be tensed or used except as willed.

Similar buoyancy mechanisms of different configurations are already known for sports, games and emergency rescue services, but these are not considered usefully adequate for physical therapy purposes such as exemplified by the instant invention. For such purposes, the device must not only support the entire body by engaging the wearer's neck and head only, but also it must be sufficiently adapted to the wearer to provide him or her with a sense of absolute safety, while at the same time it is sufficiently well fitted so that the head does not slip accidently through the neck opening.

An object of the invention is therefore to provide a muscle relaxation device which holds the human body so that it floats vertically in the water by engaging the wearer's neck and head only in a manner that the head is held in its natural position and the device conforms to the contours of the wearer's head including the relevent chin, jaw and neck parts. The device is relatively simple to produce.

That the device according to the invention allows the wearer to float in the water with his or her head held in such a manner that volunatary muscles need not be tensed should not be taken to mean the wearer must remain permanently in such a relaxed state. The capacity of the invention to permit the wearer to achieve complete muscle relaxation coupled with simultaneously freedom of movement of all body members is also particularly suitable to provide for the execution of gymnastic exercises in the water which tone the muscles and otherwise serve health purposes.

The foregoing objectives are attained by features of the invention disclosed herein. Particularly the eccentric configuration of the neck opening and in the variable contours of the surfaces which are properly adapted to the wearer's chin line provide advantageous support for the wearer's head. Also the greater area of surface provided for receiving the nape of the neck ensures the head is held upright.

So that no pressure points are created on the spinal column or musculature located at the nape of the neck, or on the throat, the device is provided with seams and special cutouts for receiving such anatomical structures.

The device in one embodiment is manufactured of nonelastic material, such as cork for example, which is subdivided so that it can be selectively opened and closed. The clearances allow adaptation to different sizes of necks by a belt-like strip surrounding and connecting two curved segments. Adaptation to the wearer's head and neck may be achieved by using elastic material which is inflated at selected different degrees. Pressure points created by the tube's seams are avoided by either providing a wide external foldable stem or an interior seam which extends in an outboard direction away from the wearer.

The safety of the inflatable device is enhanced by including two separate hermetically sealed chambers, each one of which is capable of holding the wearer's head above water level. Both chambers may be so configured and arranged that with inflation, the device's opening can be adjusted to a particular size which facilitates the contouring by the device to the wearer's physique. For security, the opening's size can additionally be adjusted and secured by a belt-like structure.

A favorable adaptation of the device to the wearer's chin, jaws and neck parts is also obtain by the special arrangement and configuration of the inside and outside strips of a double chamfered construction. The muscle relaxing device is supported in a horizontal disposition under load in the water by means of the device's legs extending forwardly of the chin area. The closed annular tube is preferably inflated following its receipt around the neck of the wearer. Thus an inflation valve is arranged in the vicinity of the wearer's chin and mouth which has a feed line for inflation. The device may also serve to receive the head of a wearer who is lying on an air mattress by being attached to an air mattress.

Other objects, adaptabilities, capabilities, and advantages of the invention will be appreciated by those skilled in the art in light of the disclosure herein and experience gained from practice of the invention.

The invention is explained in further detail by reference to the following drawings, in which:

DESCRIPTION OF THE PREFERRED EMBODIMENTS

Figure 1:
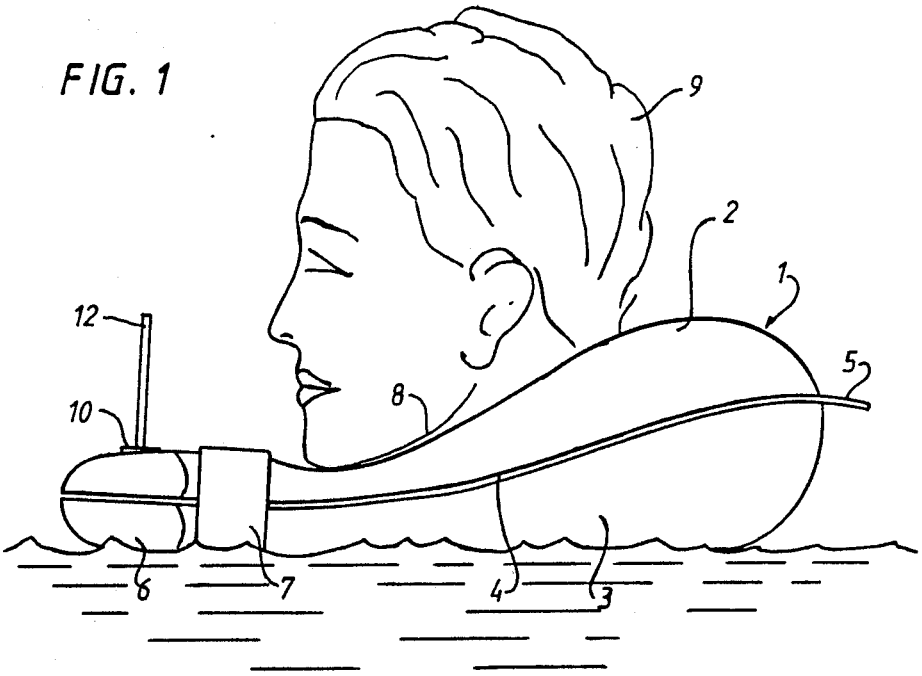
FIG. 1 shows a muscle relaxing device in accordance with the invention in side elevation as worn by person floating in the water.

FIG. 1 shows the muscle relaxing device which comprises two strips of elastic material 2 and 3 which each define generally annular complementary configurations which are sealed together along seam 4. Seam 4 widens at the astern peripheral area into a connecting member 5. Device 1 has forward leg parts 6 and 6' which are held together in the wearing position by belt 7. From FIG. 1 it should be clearly appreciated that as a result of the device's configuration, it adapts well to wearer's jaws and chin line 8. Device 1 is provided with two valves 10 and 11, to which are attached corresponding feed lines 12 and 13. Thus both chambers (as will be subsequently described) of the device can individually easily be inflated by the wearer 9 while the device is being worn.

Figure 2:
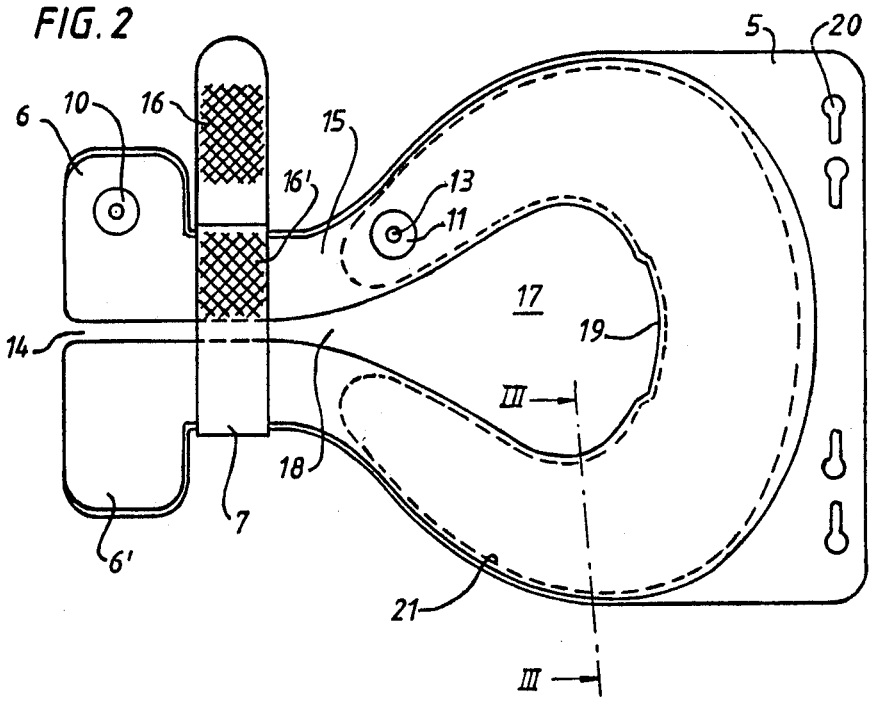
FIG. 2 is a plan view of the device of FIG. 1.

In FIG. 2, wherein it will be seen that device 1 has the general configuration of the capital Greek letter omega; there is a forward slot 14 between leg parts 6 and 6'. The closing belt 7 is received around a narrow portion of device 1 defined by leg parts 6 and 6'. Belt 7 is provided with a plurality of resilient hooks and mesh 16, 16' connectors, which form a connective device, known as "Velcro". The rounded passage between the neck opening 17 and slot 14 forms a throat cutout 18 opposite a further cutout 19 for receiving the nape of the wearer's neck.

Figure 3:
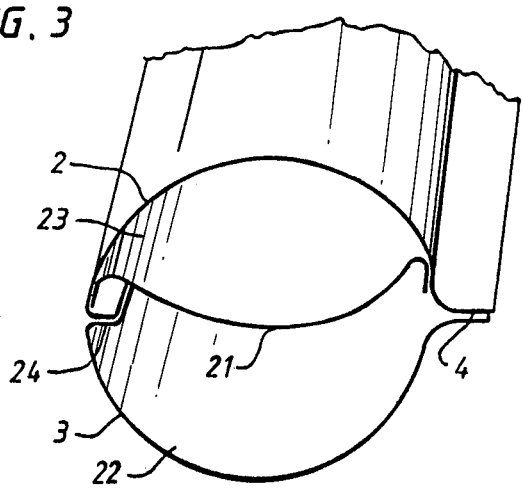
FIG. 3 is a cross-sectional perspective view illustrating the construction of the device of FIG. 1 taken on lines III—III of FIG. 2.

Connecting member 5 extends across the entire width of device 1 and is provided with four eyelets 20 for fastening the device to an air mattress or to a safety line. Affixed to the inside of the top annular outside strip 2 is an inside strip of material 21. Outside and inside strips material strips 2, 3 and 21 form two hermetically separated air chambers 22 and 23 as shown in FIG. 3. The inboard stem 24 along neck opening 17 extends in an outboard direction into the tube's interior so the edge of the seam, as such, does not project against the wearer's neck. Strip 21 is hermetically attached to strip 2 forward of valve 11 as illustrated by dashed lines in FIG. 2 to form chamber 23 between strips 2 and 21.

Figure 4:
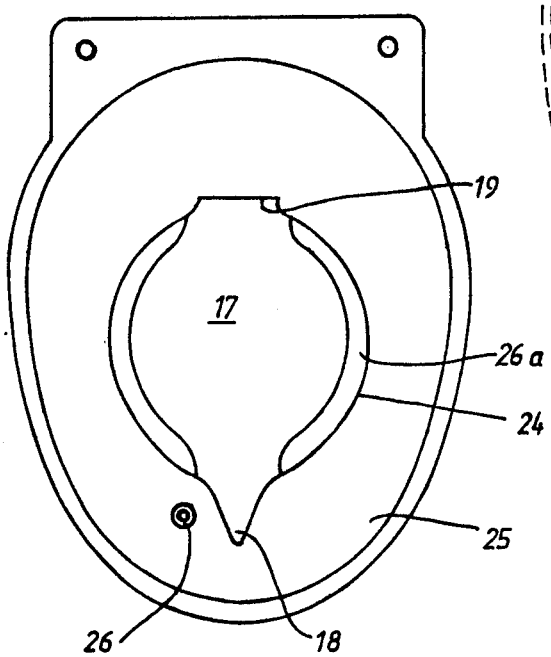
FIG. 4 shows in plan view a further embodiment of the invention.

FIG. 4 depicts a simplified embodiment of the muscle relaxing device having only one annular closed chamber 25 and one valve 26 for inflation. The inside seam 24 in neck opening 17 in this embodiment forms a wide flexible edge 26a which can engage wearer's neck. Although it projects in an inboard direction, it nevertheless avoids formation of pressure points against the neck. Throat and nape of the neck cutouts 18 and 19 respectively, are also provided in this embodiment.

Figure 5:
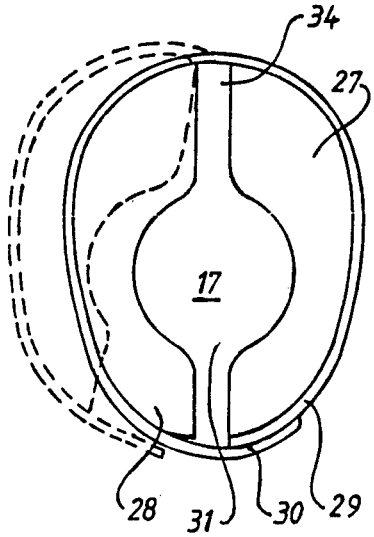
FIG. 5 illustrates a yet further device in plan view wherein, as shown in dashed lines, it is opened and, as shown in solid lines, it is closed.

A muscle relaxing device constructed of nonelastic material may be seen in FIG. 5. It comprises two generally half-torus configured segments 27 and 28. Between these segments 27 and 28, slots 31 and 34 are formed, which can be narrowed or widened according to the design diameter of neck opening 17 by means of a coupling strip 29. Strip 29 allows segments 27 and 28 to be brought together a selected amount so that they most favorably conform to the anatomy of the wearer. The overlapping part 30 of strip 29 serves for closing of the device. Strip 29 and part 30 may be constructed so as to be similar to connection 16, 16′ or other types of coupling means which will readily occur to those skilled in the art may be employed.

The device shown in FIGS. 1–3 is placed around the wearer's neck and belt 7 is adjusted and secured so that the wearer assumes a position floating in the water as seen in FIG. 1. The device shown in FIG. 4 is placed over the wearer's head prior to being inflated or being completed inflated and adjustability is attained through subsequent inflation and flexion of edge 26a to conform to the wearer's anatomy immediately under his or her jaws and chin and circumscribing the neck. The embodiment disclosed in FIG. 5 is positioned around the neck of the wearer by opening same to the location shown in dashed lines and adjustably securing same in place by means of coupling strip 29 in much the same manner as belt 7 is secured in place. With each of the embodiments positioned on a wearer as shown generally in FIG. 1, the wearer feels secure and is able to relax his or her voluntary muscles completely or to follow a regimen of prescribed exercises without being concerned about keeping his or her head above the water's surface.

It will be appreciated by those skilled in the art that although I have disclosed the preferred embodiments of my invention, it is capable of other adaptations and modifications within the scope of the following claims.

Having disclosed my invention what I claim as new and to be secured by Letters Patent of the United States is:

1. A muscle relaxing device for passive stretching of the wearer's spinal column with relaxed musculature in water, comprising a neck opening, said neck opening being arranged eccentric to the outside periphery of an annular part of the device, said annular part increasing substantially steadily in its vertical dimension and in its traverse sectional area from where the wearer's chin is to be received to where the nape of the neck is to be received so that said device safely supports the body during total relaxation of the body's voluntary muscles.

2. A device according to claim 1, wherein said opening further comprises a cutout for receiving the wearer's throat.

3. A device according to claim 1 wherein said annular part comprises two segments which are held together by a belt-like connection means surrounding both said segments and spaces between said segments form a first cutout for receiving the wearer's nape of the neck and a second cutout for receiving the wearer's throat.

4. A device according to claim 1, wherein said annular part further comprises an inflatable tube having upper and lower annular strips which are joined by a broad edge which projects into said neck opening from a portion adjacent the wearer's nape of the neck to a cutout for receiving the wearer's throat.

5. A device according to claim 1 wherein said annular part is an inflatable tube, said tube being divided into upper and lower hermetically separate chambers of different sizes which define said neck opening and a forward slot which leads into said neck opening.

6. A device according to claim 5, wherein both said chambers are formed by upper and lower strips which have substantially annular configurations and an internal strip serving as partition wall which has a length measured circumferentially which is smaller than said upper and lower strips.

7. A device to be received only around the neck of the wearer for purposes of supporting the wearer in water for relaxation or exercise of the wearer's voluntary muscles while safely holding the wearer's head in its natural upright position, the device comprising a tube which as seen in plan has generally the shape of the Greek capital letter omega, an adjustable belt means received around the legs of said omega shaped tube for adjusting the proximity of said legs to each other, said tube having an internal partition which divides said tube into upper and lower hermetically sealed spaces, the top side of said tube being conformed to receive the underside of the wearer's chin, jaw, and nape of the neck.

8. A support device for passive stretching in water of the wearer's spinal column, comprising:

a buoyant ring capable of supporting the wearer;

means for adjusting the open center of said buoyant ring;

a cutout in the inner side of said buoyant ring for receiving the wearer's throat and Adam's apple, said buoyant ring being formed to fit the wearer's chin, jaw and nape of neck line wherein that portion supporting wearer's chin has a smaller cross-section than that portion supporting the nape of wearer's neck and the cross-section gradually increases from said chin portion to said nape portion along the wearer's jawline.

9. A support device as claimed in claim 8 wherein said buoyant ring further comprises:

a means for inflating said buoyant ring;

an inside seam extending on each side of said ring from a point adjacent the nape of the wearer's neck to said cutout; and means for attaching said buoyant ring to an air mattress or safety line.

10. A support device as claimed in claim 8 wherein said buoyant ring comprises two half-torus segments and a strip for adjustably connecting said half-torus segments.

11. A support device for passive stretching in water of the wearer's spinal column, comprising:

a buoyant ring capable of supporting the wearer, said buoyant ring, when viewed in plan, being generally in the shape of the Greek capital letter Omega and having an internal partition which divides said buoyant ring into upper and lower hermetically sealed chambers, said buoyant ring being formed to fit the wearer's chin, jaw and nape of neck line wherein that portion supporting wearer's chin has a smaller cross-section than that portion supporting the nape of wearer's neck and the cross-section gradually increases from said chin portion to said nape portion along the wearer's jawline;

means for adjusting the relative size of the open center of said buoyant ring, said means comprising an adjustable belt means received around the legs of said Omega shaped buoyant ring, said adjustable belt for adjusting said legs to each other;

a cutout in the inner side of said buoyant ring for receiving the wearer's throat and Adam's apple;

means for inflating said buoyant ring; and means for attaching said buoyant ring to an air mattress or safety line.

12. An annular support device for passively stretching, in water, a wearer's spinal column, comprising;

a tube which, as seen in plan, has generally the shape of the Greek capital letter Omega;

a means for adjusting the size of an opening between the legs of said Omega shaped tube;

a cutout for receiving the throat of the wearer formed in the eccentric portion of said Omega shaped tube from which said legs extend;

a portion of said Omega shaped tube for supporting the nape of the neck of the wearer opposite said opening between said legs;

wherein said tube's annular cross section gradually increases from said cutout for receiving wearer's throat to said portion adjacent the nape of the neck of wearer such that said tube fits the wearer's chin, jaw, and nape of the neckline.

* * * * *